US006880614B2

(12) United States Patent
Hirai et al.

(10) Patent No.: US 6,880,614 B2
(45) Date of Patent: Apr. 19, 2005

(54) VERTICAL INJECTION MACHINE USING THREE CHAMBERS

(75) Inventors: Kinji Hirai, Kanagawa (JP); Hisayuki Fukada, Shizuoka (JP); Yuuji Osada, Kanagawa (JP)

(73) Assignee: Takata Corporation, Tokyo (JP)

( * ) Notice: Subject to any disclaimer, the term of this patent is extended or adjusted under 35 U.S.C. 154(b) by 77 days.

(21) Appl. No.: 10/440,412

(22) Filed: May 19, 2003

(65) Prior Publication Data

US 2004/0231821 A1 Nov. 25, 2004

(51) Int. Cl.[7] ..... B22D 17/08; B22D 17/12; B22D 39/02

(52) U.S. Cl. ..... 164/113; 164/133; 164/136; 164/312; 164/337

(58) Field of Search ..... 164/113, 133, 164/136, 312, 337

(56) References Cited

U.S. PATENT DOCUMENTS

| | | | |
|---|---|---|---|
| 2,386,966 | A | 10/1945 | MacMillin |
| 2,505,540 | A | 4/1950 | Goldhard |
| 2,529,146 | A | 11/1950 | Feitl |
| 2,785,448 | A | 3/1957 | Hodler |
| 3,048,892 | A | 8/1962 | Davis, Jr. et al. |

(Continued)

FOREIGN PATENT DOCUMENTS

| | | |
|---|---|---|
| DE | 196 11 419 | 9/1996 |
| EP | 0 476 643 | 3/1992 |
| EP | 0 761 344 | 3/1997 |
| EP | 1 038 614 A1 | 9/2000 |
| FR | 1.447.606 | 11/1996 |

(Continued)

OTHER PUBLICATIONS

Mehrabian et al., "Casting in the Liquid–Solid Region," *New Trends in Materials Processing,* papers presented at a seminar of American Society for Metals, Oct. 19 and 20, 1974, ASM, Metals Park, OH, pp. 98–127.

Flemings et al., "Rheocasting," *Challenges and Opportunities in Materials Science and Engineering* (Anniversary Volume), vol. 25 (1976), Elsevier Sequoia S.A., Lausanne, pp. 103–117.

Flemings et al., "Rheocasting," *McGraw–Hill Yearbook of Science and Technology, 1977,* McGraw–Hill Book Company, NY, pp. 49–58.

Laxmanan et al., "Deformation of Semi–Solid Sn–15 Pct. Pb Alloy," *Metallurgical Transactions A,* vol. 11A: No. 12, Dec. 1980, pp. 1927–1937.

Matsumiya et al., "Modeling of Continuous Strip Production by Rheocasting" *Metallurgical Transactions B,* vol. 12B, No. 1, Mar. 1981, pp. 17–31.

Suery et al., "Effect of Strain Rate on Deformation Behavior of Semi–Solid Dendritic Alloys," *Metallurgical Transactions A,* vol. 13A, No. 10: Oct. 1982, pp. 1809–1819.

(Continued)

*Primary Examiner*—Kuang Y. Lin
(74) *Attorney, Agent, or Firm*—Foley & Lardner LLP

(57) ABSTRACT

A vertical injection machine having a first chamber for supplying liquid metal, a second chamber located lower than the first chamber and a first conduit connecting the first chamber to the second chamber. The first conduit has a shutter rod disposed within and a valve head attached to a lower portion of the shutter rod. The valve head is adapted to seal a lower portion of the first conduit. A metering rod is disposed within the second chamber. The vertical injection machine also includes a vertically oriented third chamber and a second conduit connecting the second chamber to the third chamber. An injection rod is disposed vertically within the third chamber and a injection nozzle is located at an upper portion of the third chamber.

23 Claims, 4 Drawing Sheets

U.S. PATENT DOCUMENTS 3,106,002 A 10/1963 Bauer
3,123,875 A 3/1964 Madwed
3,172,174 A 3/1965 Johnson
3,189,945 A 6/1965 Strauss
3,201,836 A 8/1965 Nyselius
3,254,377 A 6/1966 Morton
3,268,960 A 8/1966 Morton
3,270,378 A 9/1966 Madwed
3,270,383 A 9/1966 Hall et al.
3,286,960 A 11/1966 Douglas et al.
3,319,702 A 5/1967 Hartwig et al.
3,344,848 A 10/1967 Hall et al.
3,447,593 A 6/1969 Nyselius et al.
3,474,954 A 10/1969 Mace
3,491,827 A 1/1970 Mace
3,529,814 A 9/1970 Werner
3,550,207 A 12/1970 Struss
3,693,702 A 9/1972 Piekenbrink et al.
3,773,873 A 11/1973 Spaak et al.
3,810,505 A 5/1974 Cross
3,814,170 A 6/1974 Kahn
3,874,207 A 4/1975 Lemelson
3,893,792 A 7/1975 Laczko
3,902,544 A 9/1975 Flemings et al.
3,936,298 A 2/1976 Mehrabian et al.
3,976,118 A 8/1976 Kahn
4,049,040 A 9/1977 Lynch
4,088,178 A 5/1978 Ueno et al.
4,168,789 A 9/1979 Deshais et al.
4,212,625 A 7/1980 Shull
4,287,935 A 9/1981 Ueno et al.
4,330,026 A 5/1982 Fink
4,347,889 A 9/1982 Komatsu et al.
4,387,834 A 6/1983 Bishop
4,434,839 A 3/1984 Vogel
4,436,140 A 3/1984 Ebisawa et al.
4,473,103 A 9/1984 Kenney et al.
4,476,912 A 10/1984 Harvill
4,510,987 A 4/1985 Collot
4,534,403 A 8/1985 Harvill
4,537,242 A 8/1985 Pryor et al.
4,559,991 A 12/1985 Motomura et al.
4,586,560 A 5/1986 Ikeya et al.
4,635,706 A 1/1987 Behrens
4,687,042 A 8/1987 Young
4,694,881 A 9/1987 Busk
4,694,882 A 9/1987 Busk
4,730,658 A 3/1988 Nakano
4,771,818 A 9/1988 Kenney
4,828,460 A 5/1989 Saito et al.
4,834,166 A 5/1989 Nakano
4,884,621 A 12/1989 Ban et al.
4,898,714 A 2/1990 Urban et al.
4,952,364 A 8/1990 Matsuda et al.
4,997,027 A 3/1991 Akimoto
5,040,589 A 8/1991 Bradley et al.
5,109,914 A 5/1992 Kidd et al.
5,143,141 A 9/1992 Frulla
5,144,998 A 9/1992 Hirai et al.
5,161,598 A 11/1992 Iwamoto et al.
5,181,551 A 1/1993 Kidd et al.
5,186,236 A 2/1993 Gabathuler et al.
5,191,929 A 3/1993 Kubota et al.
5,205,338 A 4/1993 Shimmell
5,244,033 A 9/1993 Ueno
5,375,645 A 12/1994 Brueker et al.
5,380,187 A 1/1995 Fujikawa
5,388,633 A 2/1995 Mercer, II et al.
5,394,931 A 3/1995 Shiina et al.
5,413,644 A 5/1995 Marder et al.
5,454,423 A * 10/1995 Tsuchida et al. ..... 164/337
5,501,266 A 3/1996 Wang et al.
5,531,261 A 7/1996 Yoshida et al.
5,533,562 A 7/1996 Moschini et al.
5,571,346 A 11/1996 Bergsma
5,575,325 A 11/1996 Sugiura et al.
5,577,546 A 11/1996 Kjar et al.
5,601,136 A 2/1997 Shimmell
5,622,216 A 4/1997 Brown
5,623,984 A 4/1997 Nozaki et al.
5,630,463 A 5/1997 Shimmell
5,630,466 A 5/1997 Garat et al.
5,638,889 A 6/1997 Sugiura et al.
5,657,812 A 8/1997 Walter et al.
5,662,159 A 9/1997 Iwamoto et al.
5,664,618 A 9/1997 Kai et al.
5,665,302 A 9/1997 Benni et al.
5,680,894 A 10/1997 Kilbert
5,685,357 A 11/1997 Kato et al.
5,697,422 A 12/1997 Righi et al.
5,697,425 A 12/1997 Nanba et al.
5,701,942 A 12/1997 Adachi et al.
5,704,411 A 1/1998 Suzuki et al.
5,716,467 A 2/1998 Marder et al.
5,730,198 A 3/1998 Sircar
5,730,202 A 3/1998 Shimmell
5,735,333 A 4/1998 Nagawa
5,770,245 A 6/1998 Takizawa et al.
5,836,372 A 11/1998 Kono
5,839,497 A 11/1998 Fujino et al.
5,861,182 A 1/1999 Takizawa et al.
5,913,353 A 6/1999 Riley et al.
5,983,976 A 11/1999 Kono
6,065,526 A 5/2000 Kono
6,135,196 A 10/2000 Kono
6,241,001 B1 6/2001 Kono
6,276,434 B1 8/2001 Kono
6,283,197 B1 9/2001 Kono
6,284,167 B1 9/2001 Fujikawa

FOREIGN PATENT DOCUMENTS

JP 59-152826 8/1984
JP 1-166874 6/1989
JP 1-178345 7/1989
JP 1-192447 8/1989
JP 2-202420 8/1990
JP 5-8016 1/1993
JP 5-8017 1/1993
JP 2-274360 1/1993
JP 5-285626 11/1993
JP 5-285627 11/1993
JP 6-306507 11/1994
JP 7-51827 2/1995
JP 8-72110 3/1996
JP 8-174172 7/1996
JP 8-252661 10/1996
JP 9-103859 4/1997
JP 9-155524 6/1997
JP 9-155526 6/1997
JP 9-155527 6/1997
JP 9-295122 11/1997
JP 2001-150124 A 6/2001
JP 2002-137052 A 5/2002
JP 2002-273564 A 9/2002
TW 153528 3/1991
WO 92/13662 8/1992
WO 97/21509 6/1997
WO 97/45218 12/1997
WO 99/28065 6/1999
WO 99/50007 10/1999

OTHER PUBLICATIONS

Worthy, Ward, "Injection Molding of Magnesium Alloys," *Chemical & Engineering News,* vol. 66, No. 23, Jun. 6, 1988, pp. 29–30.

Tissier et al., "Magnesium rheocasting: a study of processing–microstructure interactions," *Journal of Materials Science,* vol. 25 (1990). Chapman and Hall Ltd., pp. 1184–1196.

Carnahan et al., "New Manufacturing Process for Metal Matrix Composite Synthesis," *Fabrication of Particulates Reinforced Metal Composites,* Proceedings of an International Conference, Montreal, Quebec, Sep. 17–29, 1990, ASM International, Metals Park, Ohio, pp. 101–105.

Flemings, "Behavior of Metal Alloys in the Semisolid State," *Metallurgical Transactions B,* vol. 22B, No. 3, Jun. 1991, pp. 269–293.

Pasternak et al., "Semi–Solid Production Processing of Magnesium Alloys by Thixomolding," Proceedings of the Second International Conference on the Semi–Solid Processing of Alloys and Composites, MIT, Cambridge, MA, Jun. 10–12, 1992, TMS, Warrendale, PA, pp. 159–169.

Brown et al., "Net Shape Forming via Semi–Solid Processing," *Advanced Materials & Processes,* vol. 143, No. 1, Jan. 193, ASM International, Metals Park, OH, pp. 36–40.

Carnahan et al., "Advances in Thixomolding," 52$^{nd}$ Annual World Magnesium Conference, Berlin, Germany, May 17–19, 1994, (6 pages).

Fujikawa, Misao, Conference Material, Sodick Plastech Co., Ltd., Jul. 1995, pp. 1–14.

Staff Report, "Semi–Solid Metalcasting Gains Acceptance, Applications," *Foundry Management & Technology,* Nov. 1995, Japan, pp. 23–26.

Tuparl Injection Molding Machine Advertisement, Sodick Plastech Co., Ltd., May 1997, (8 pages).

Kalpakjian, Serope, *Manufacturing Processes for Engineering Materials,* 3rd edition, Addison Wesley Longman, Inc., Menlo Park, CA, 1997, pp. 261–263, 265–266.

"Plastic Processing Technology Book," Published in Japan (ISBN 4–526–00035–3), pp. 134–136.

Material Science & Technology Textbook, Fig. 1–67(b), p. 52.

* cited by examiner

VERTICAL INJECTION MACHINE USING THREE CHAMBERS

FIELD OF THE INVENTION

The invention relates to a method and apparatus for manufacturing metallic parts, more particularly to a method and apparatus for manufacturing metallic parts by a process involving injection of liquid metal into a mold, including die casting methods.

BACKGROUND OF THE INVENTION

Conventional die casting apparatus are classified into cold chamber and hot chamber. In cold chamber die casting apparatus, molten metal is poured into a sleeve which is secured on a die plate and connected to an inlet opening to the mold cavity. Molten metal is injected by a plunger into the die. The molten metal in the sleeve is easily cooled down when it spreads at the bottom of the sleeve as the plunger moves forward slowly to discharge air or gas. Cooled molten metal in the sleeve forms a chilled fraction and semi-solid or solid particles. The chilled fraction and particles are injected into the molding die causing the physical properties of molded parts to be deteriorated.

Cooled molten metal increases the viscosity of the molten metal and makes it difficult to fill the mold cavity. Further, it causes blemishes on surface of a molded part. This is a serious problem particularly for magnesium alloys for which the latent heat of solidification is small (smaller than aluminum, lead and zinc). Because of the small latent heat of solidification, magnesium solidifies quickly when it comes in contact with materials having a lower temperature.

Hot sleeves have been used, but the heated sleeve is not as hot as liquidus temperature of the metal because the sleeve is connected to a molding die whose temperature has to be below the solidus temperature of the metal. The molding die temperature must be sufficiently below the solidus temperature of the molten metal to produce an adequate solidification rate. That is, a solidification rate which reflects the required time for an operation cycle. Molten metal poured into the sleeve has a substantially higher temperature than the liquidus temperature of the metal to counter the cooling in the sleeve. This is a disadvantage in energy cost for heating.

The cold chamber apparatus forms a thick round plate as a part of the casting, often called a biscuit, in the sleeve between a plunger head and an inlet of a die. After the casting is pulled away from the molding dies when the dies are opened, the biscuit is cut away from the casting and recycled. However, sometimes the biscuit is larger than the product. This is a disadvantageous use of metal which has a substantial recycling cost.

In hot chamber die casting apparatus, an injection mechanism is submerged in molten metal in a furnace. The temperature of the molten metal to be injected is maintained above its liquidus. The injection mechanism has a shot cylinder with a plunger, gooseneck chamber and a nozzle at the end of thereof. The molten metal is injected through a gooseneck-type passage and through a nozzle into the die cavity without forming a biscuit. This is an advantage of hot chamber die casting apparatus.

Another advantage of a hot chamber apparatus over a cold chamber apparatus is the time for an operation cycle. As mentioned above, in cold chamber apparatus, the casting is formed by injecting molten metal into a mold cavity between closed dies and cooling to until the casting is solid. The dies are separated and the molded part is pulled away, lubricant is sprayed onto the opened dies, and the dies are closed again. Then, the dies are ready to start the next operation cycle. The molten metal is poured into the injection sleeve when the molding dies are closed, i.e., when the dies are ready to start the next operation cycle, so that the molten metal does not spill out from the inlet opening of the die because the injection sleeve directly communicates with a die.

On the other hand, hot chamber die casting apparatus fill molten metal in the gooseneck and a shot cylinder system by returning an injection plunger to its fill up position. Molten metal is supplied through an opening or fill port on a shot cylinder. While cooling the injected molten metal in the dies, the nozzle is positioned by inclining the gooseneck chamber. The molten metal in the nozzle gooseneck system tends to flow back into the furnace through the fill port on the shot sleeve, reaching a hydrostatic level when the dies are opened. By simultaneously filling molten metal into the gooseneck and a shot cylinder system and cooling injected metal in the closed dies, time for an operation cycle of the hot chamber apparatus is shortened compared with the cold chamber die casting apparatus.

However, solidification of the molten metal in the nozzle section of the gooseneck and dripping of molten metal from the nozzle and the cast sprue are problems for hot chamber die casting apparatus. It is known that in hot chamber die casting apparatus a vacuum is created in the injection mechanism when the plunger is withdrawn. However, the vacuum is instantaneously destroyed once the plunger passes the opening or fill port on the shot cylinder supplying molten metal from the furnace because the furnace is at atmospheric pressure. Thus, the molten metal is sucked into the shot cylinder, and the gooseneck and the nozzle are completely filled at the time that the casting is solidified and the dies are separated.

There is molten metal in the nozzle for most of the time that the casting is cooling. When the cooling at the tip of the nozzle is properly controlled, it is understood in the industry that the metal in the nozzle tip becomes semi-solid. The formed semi-solid metal works as a plug which prevents molten metal from dripping out of the nozzle when the dies are separated. If the cooling is insufficient, the metal in the tip of the nozzle and the cast sprue is still liquid when the dies are separated and dripping occurs. On the other hand, when too much cooling is applied, the metal in the nozzle tip solidifies and freezes together with the cast sprue. The casting will stick in the stationary die after the dies open.

U.S. Pat. Nos. 3,123,875, 3,172,174, 3,270,378, 3,474,875 and 3,491,827 propose creating a vacuum in the gooseneck by return or reverse stroke of the plunger to draw back molten metal from the nozzle and extreme tip of the sprue. These patents disclose mechanisms attached to the shot cylinder and a plunger system so that the created vacuum is kept intact until after the dies have been separated and the solidified casting has been withdrawn from the sprue opening of the stationary die.

Problems in the hot chamber die casting apparatus are caused because a heavy injection mechanism is submerged in the molten metal in the furnace. The injection mechanism with a gooseneck chamber and a shot cylinder system is difficult to clean up. It is also difficult to replace worn plunger rings and sleeves. A worn plunger ring and sleeve decreases injection pressure due to leakage and makes shot volume inconsistent in filling the mold cavity. The inconsistent shot volume produces inconsistent molded parts.

Die casting apparatus are also classified according to the arrangement of the injection system, that is, horizontal and vertical. In a horizontal die casting apparatus, an injection system is horizontally arranged for horizontally injecting molten metal into molding dies. A vertical die casting apparatus has a vertically arranged injection system for vertical injection of molten metal.

Conventional vertical die casting apparatus typically are vertically arranged cold chamber apparatus that have the same advantages and disadvantages of the cold chamber apparatus described above. However, a feature of the vertical die casting apparatus is that the inlet opening for molten metal can be on top of the vertical injection chamber. This arrangement is not applicable to the horizontally arranged apparatus. In U.S. Pat. Nos. 4,088,178 and 4,287,935, Ube discloses machines in which a vertical casting sleeve is pivotally mounted to a base and slants from perpendicular position to accept molten metal. In place of supplying molten metal to the casting sleeve, Nissan Motors discloses in U.S. Pat. No. 4,347,889 a vertical die casting machine in which a vertical casting sleeve moves downward and a solid metal block is inserted. The inserted metal block is melted in the sleeve by an high frequency induction coil. The problem with these apparatus is the complexity of their structure.

SUMMARY OF THE INVENTION

One embodiment of the present invention includes a vertical injection machine comprising a first chamber for supplying liquid metal, a second chamber located lower than the first chamber, a first conduit connecting the first chamber to the second chamber, the first conduit having a shutter rod disposed therein, a valve head attached to a lower portion of the shutter rod, the valve head adapted to seal a lower portion of the first conduit, a metering rod disposed within the second chamber, a vertically oriented third chamber, a second conduit connecting the second chamber to the third chamber, an injection rod disposed vertically within the third chamber and an injection nozzle located at an upper portion of the third chamber.

Another embodiment of the present invention includes method of injection molding comprising melting metal into a liquid state in a first chamber, passing a portion of the liquid metal to a first conduit, allowing the portion of melted metal to flow from the first conduit into a second chamber located below the first chamber by opening a shutter disposed in the first conduit, withdrawing a metering rod in the second chamber and stopping a flow of metal from the first conduit into the second chamber by closing the shutter in the first conduit. The method also comprises retracting an injection rod in a third chamber to expose a first opening from the second chamber into the third chamber, advancing the metering rod to force the portion of metal from the second chamber to the third chamber via the first opening, advancing the injection rod to close the first opening and to exhaust air in the third chamber, and elevating the third chamber towards a stationary mold; and advancing the injection rod to inject the portion of liquid metal from the third chamber through a nozzle into the mold.

Another embodiment of the present invention includes a vertical injection machine comprising a vertical injection machine comprising a first chamber containing a heating means for melting metal into a liquid state in a first chamber, a second chamber, a passing means for passing a portion of the liquid metal from the first chamber into the second chamber and a sealing means for sealing the passing means. The machine also comprises a vertically oriented third chamber, a metering means for drawing in liquid metal from the first chamber into the second chamber and for forcing the portion of metal from the second chamber to the third chamber, an injection means for sealing an opening between the third chamber and the second chamber and for injecting liquid metal from the third chamber into a mold, and a lifting means for lifting the vertical injection machine toward the mold prior to injecting the liquid metal into the mold and for lowering the vertical injection molding machine away from the mold after injecting the liquid metal into the mold.

BRIEF DESCRIPTION OF THE DRAWINGS

The foregoing and other features, aspects and advantages of the present invention will become apparent from the following description, appended claims and the exemplary embodiments shown in the drawings, which are briefly described below. It should be noted that unless otherwise specified like elements have the same reference numbers.

DETAILED DESCRIPTION OF THE PREFERRED EMBODIMENTS

Figure 1:
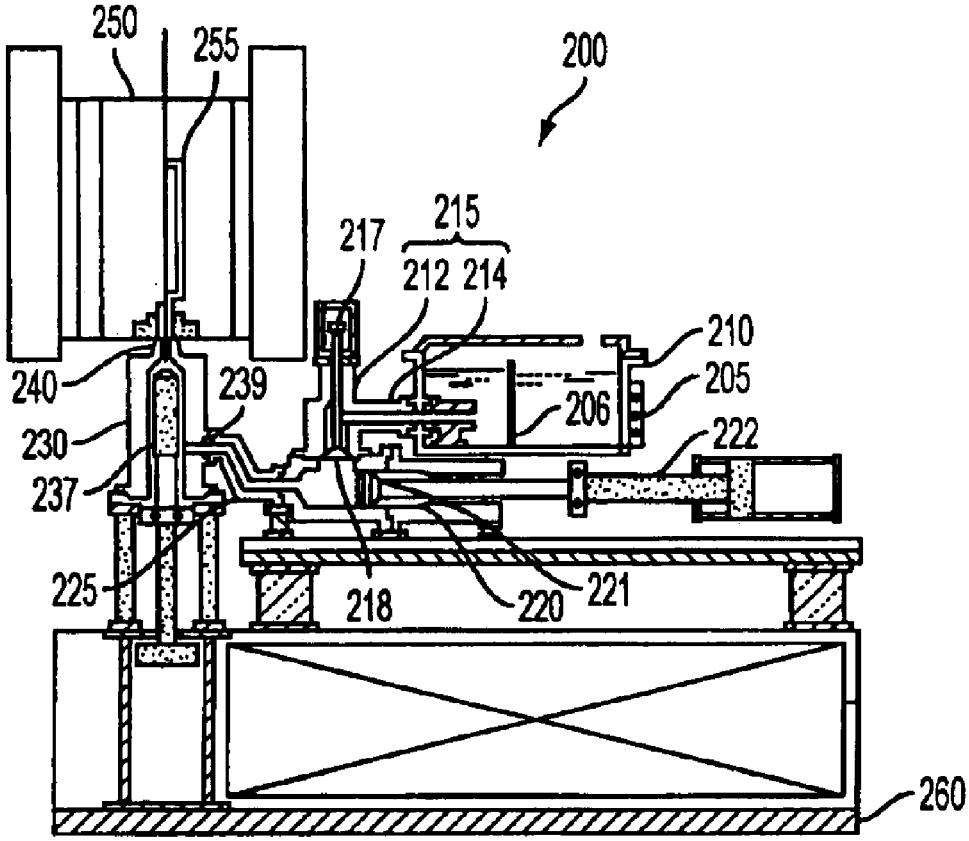
FIG. 1 is schematic diagram of a multichamber vertical injection machine according to one embodiment of the invention.

The present inventors have discovered an improved machine for manufacturing molded metallic parts that is capable of accurately metering metal and reducing or eliminating leakage. The machine includes a conduit between a melt feeder and a metering chamber and has a shutter rod disposed within it. The shutter rod has a valve head attached to a lower portion and is adapted to seal a lower portion of the conduit. The inventors have found that this arrangement provides significantly better sealing than found in conventional multichamber injection machines. This, in turn, provides greater control over metering as will be discussed in more detail below.

FIGS. 1–4 illustrate a metal die casting machine according to one embodiment of the invention. The injection machine 200 of this embodiment includes a melt furnace 210 in which solid metal is melted to a liquid state. The solid metal may be ingot, pellet, powder or any other suitable metal source. The melt furnace has a heating source 205 which provides sufficient heat to liquefy the metal. Preferably, the melt furnace 210 contains a plate 206 with an opening through which liquid metal can pass while solid metal sinks to the bottom of the melt furnace 210. Located below the melt furnace 210 is a metering chamber 220. Connecting the melt furnace 210 and the metering chamber 220 is a first conduit 215.

In a preferred embodiment of the invention, the first conduit 215 has two portions. The first portion is a horizontal portion 214 connected to the melt furnace 210 and the second portion is a vertical portion 212 connected to the metering chamber 220. Disposed within the second portion 212 and adapted for axial movement is a shutter rod 217. Attached to a lower portion of the shutter rod 217 is a valve head 218. The valve head 218 is adapted to mate with a opening 219 (FIG. 2) in the lower part of the vertical portion 212 of the first conduit 215. The shape of the valve head 218 is an inverse of the opening 219 in the vertical portion 212 of the first conduit 215. In one embodiment of the invention, the valve head 218 is conical with the wider part located below the narrower part. However, the valve head 218 may also be spherical, hemispherical or any other shape which can be adapted to seal the lower portion of the first conduit 215.

The opening 219 provides access into the top of the metering chamber 220. The metering chamber 220 is preferably oriented horizontally. A second conduit 225 is located at one end of the metering chamber 220. The second conduit 225 connects the metering chamber 220 with the injection chamber 230. A metering rod 222 is located at the other end of the metering chamber 220. Surrounding a head of the metering rod 222 is at least one ring 221 to reduce or preferably eliminate leakage of liquid metal past the head of the metering rod 222. Optionally, a plurality of rings may be used.

The second conduit 225 connects to an opening 239 (FIG. 1) in a side wall of the injection chamber 230. The opening 239 is preferably located above the upper wall of the metering chamber 220 to avoid having metal flow from the metering chamber into the injection chamber 230 by the force of gravity. Thus, the conduit 225 is preferably inclined upwards from the metering chamber towards the injection chamber. The injection chamber 230 is preferably oriented vertically. At the upper end of the injection chamber 230 is an injection nozzle 240. At the lower end of the injection chamber 230 is a injection rod 237. Preferably, the front face 231 of the injection rod 237 is substantially flat. However, the front face 231 of the injection rod 237 may have beveled edges.

In a preferred embodiment of the invention, the injection machine 200 is mounted on a lifting base 260. The lifting base 260 contains components to lift the entire injection machine 200 toward a stationary mold 250 (typically comprising dies) having a mold cavity 255. The lifting components may be electronic, mechanical, hydraulic or any combination thereof. In an alternative embodiment of the invention, the injection machine 200 is held stationary and the mold 250 is configured to move relative to the injection machine 200.

When operating the injection machine 200 according a first preferred method, solid metal is charged into the melt furnace 210. Preferably, the solid metal is charged into the right side of the melt furnace. After the solid metal is liquefied, it flows through the plate 206 into the left side of the melt furnace. When a sufficient amount of metal is liquefied in the melt furnace 210, the liquid metal flows into conduit 215. The liquid metal flows through the horizontal portion 214 and then fills the vertical portion 212.

Initially, the shutter rod 217 is in a retracted position causing the valve head 218 to seal the opening 219 into the metering chamber 220. In this position, the metal does not flow into the metering chamber 220 from the conduit 215 (FIG. 1). At this time, in one preferred embodiment of the invention, the injection rod 237 is positioned in the injection chamber 230 such that a side of the injection rod 237 seals the opening 239 between the conduit 225 and the injection chamber, thus, preventing the flow of metal from the metering chamber 220 to the injection chamber 230. Further, the metering rod 222 is positioned in a forward location with the front face of the metering rod 222 located slightly behind opening 219 of the metering chamber 220.

Figure 2:
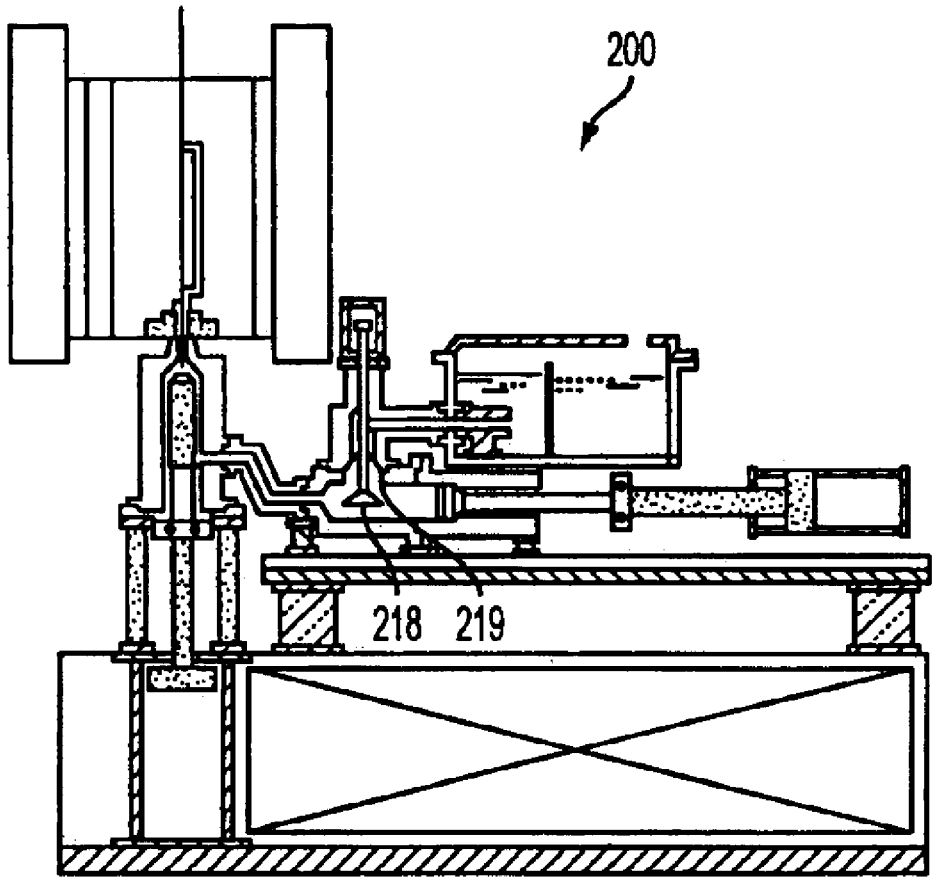
FIG. 2 is schematic diagram of a multichamber vertical injection machine according to one embodiment of the invention.

To fill the metering chamber 220, the shutter rod 217 is lowered, breaking the seal between the valve head 218 and the opening 219 (FIG. 2). At the same time, the metering rod 222 is retracted, creating suction which assists in drawing liquid metal from the melt furnace 210 through the conduit 215 into the metering chamber 220. The distance the metering rod 222 is retracted depends on the size of the required charge. The metering rod 222 could be fully retracted. Thus, the liquid metal flows into the metering chamber 220 due to gravity and due to suction created by retracting the metering rod 222. In this manner, the volume of the liquid metal in chamber 220 can be accurately controlled.

Figure 3:
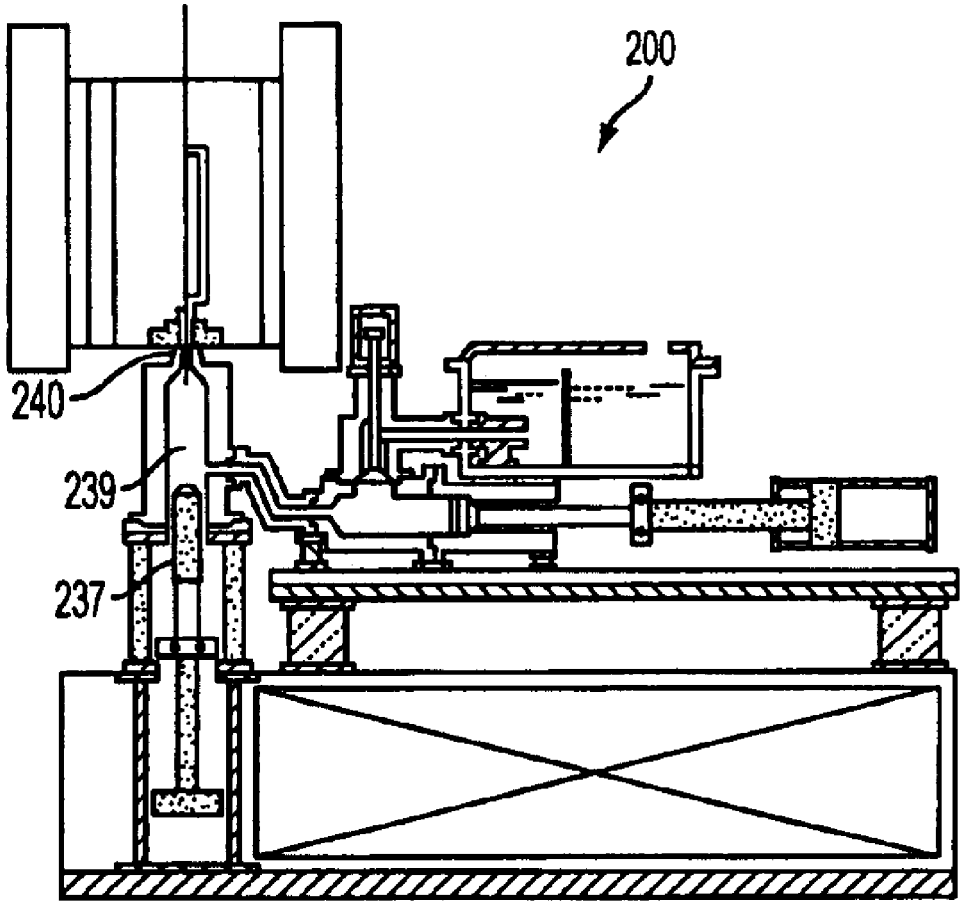
FIG. 3 is schematic diagram of a multichamber vertical injection machine according to one embodiment of the invention.
Figure 4:
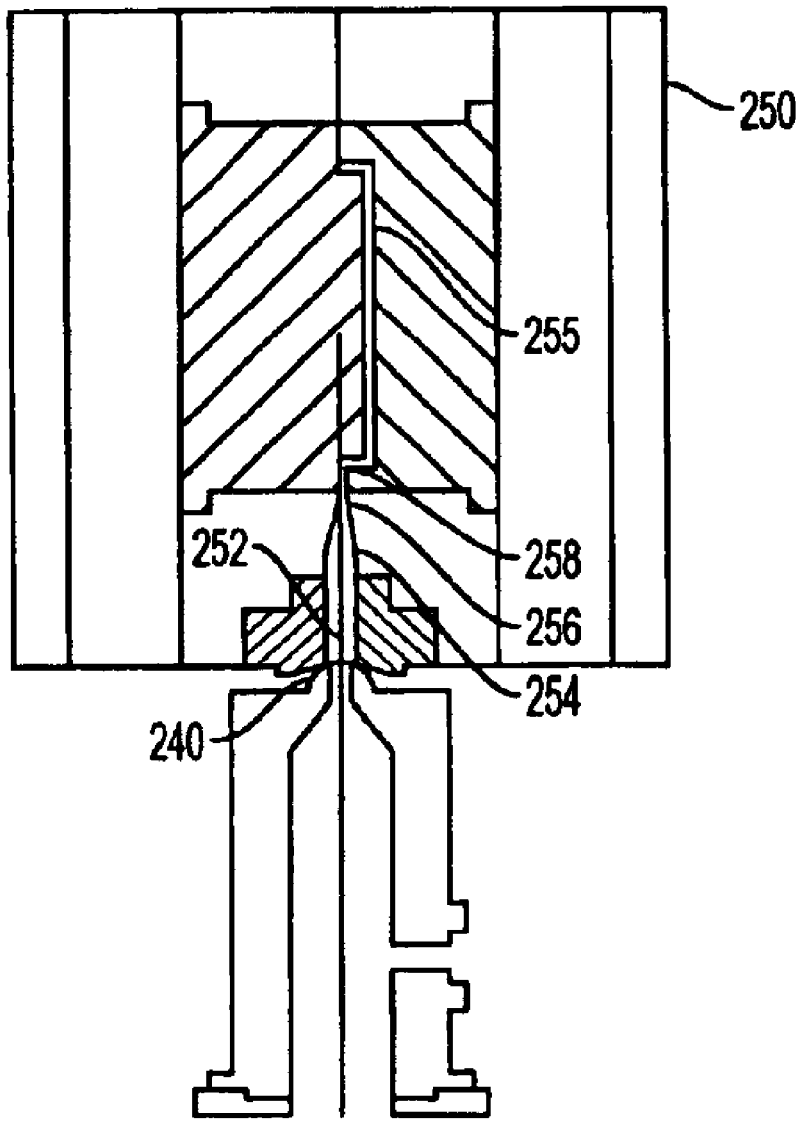
FIG. 4 is a detail view of the embodiment illustrated in FIG. 2 also illustrating the preferred sprue arrangement.

When the volume of metal in the metering chamber 220 is sufficient for injection molding, the shutter rod 217 is retracted upwards, sealing the opening 219 with the valve head 218 (FIG. 3). In the first run after shutdown, extra metal sufficient to fill the second conduit 225 is allowed to flow into the metering chamber 220. Any trapped air which may be in the second conduit 225 is pushed out to the injection chamber 230 and exhausted in the first run. Further, subsequent runs need only meter out the exact amount of liquid metal required to fill the mold 250.

At this point, the injection rod 237 in the injection chamber 230 is retracted from an upper position to a lower position to expose the opening 239 in the injection chamber 230. The metering rod 222 is then advanced to the position shown in FIG. 1 to force a precisely metered amount of the liquid metal from the metering chamber 220 into the injection chamber 230. The advanced distance of the metering rod 222 corresponds to the required metal volume for a shot. Since the upper wall of the metering chamber is located below the opening 239 and the conduit 225 is inclined, metal does not flow from the metering chamber 220 into the injection chamber 230 due to gravity, thus allowing a precisely metered amount of the liquid metal to flow from the metering chamber 220 into the injection chamber 230 due to the forward movement of the metering rod 222. When the injection chamber 230 is filled, that is, when the desired amount of liquid metal for injection is in the injection chamber 230, the injection rod 237 is slowly advanced to close the opening 239 in the injection chamber 230 and to drive off any air which remains in the injection chamber 230.

Then, in a preferred embodiment of the invention, the entire injection machine 200 is lifted toward the mold 250.

The injection rod 237 is advanced upwards to inject liquid metal from the nozzle 240 into the mold 250 as shown in FIG. 1. The injection rod 237 is advanced at least 15, preferably at least 50 times as fast in the injection step as in the step of closing the opening 239. In a preferred embodiment of the invention, the mold 250 has an inverted sprue 254 having a roughly funnel shape with the wider opening 252 facing the injection nozzle 240 and the narrower opening 256 connecting to a gate 258. The injection machine 200 remains in the upper position until the casting and the gate 258 solidify. Then the injection rod 237 is lowered. Any molten metal remaining in the sprue 254 and the nozzle 240 falls back into the injection chamber 230. In this manner of operation, no solid plug is formed in the injection nozzle 240.

In another embodiment of the invention, the injection rod is lowered quickly and the nozzle 240 is separated from the mold 250 immediately after a gate 258 is solidified so that excessive heating of the dies and cooling of the nozzle 240 and the injection chamber 230 are avoided. In another embodiment, molten or semi-solid metal in the sprue 254 and the nozzle 240 is sucked back to the injection chamber 230 by the retraction of the injection rod before the nozzle 240 is separated from the mold 250 to prevent formation of a solid plug. The semi-solid metal may then be re-melted with the next charge of liquid metal.

Finally, the injection machine 200 is lowered. At the same time, the mold 250 is opened and the molded part is removed while the metering chamber 220 is filled and a precisely metered amount of liquid metal is forced from the metering chamber 220 into the injection chamber 230 for the next cycle. Additionally, the dies which comprise the mold 250 are lubricated for the next casting.

The foregoing description of the invention has been presented for purposes of illustration and description. It is not intended to be exhaustive or to limit the invention to the precise form disclosed, and modifications and variations are possible in light of the above teachings or may be acquired from practice of the invention. The drawings and description were chosen in order to explain the principles of the invention and its practical application. It is intended that the scope of the invention be defined by the claims appended hereto, and their equivalents.

What is claimed is:

1. A cold chamber vertical injection machine comprising:

a first chamber for supplying liquid metal;

a second chamber located lower than the first chamber;

a first conduit connecting the first chamber to the second chamber, the first conduit having a shutter rod disposed therein;

a valve head attached to a lower portion of the shutter rod, the valve head adapted to seal a lower portion of the first conduit;

a metering rod disposed within the second chamber;

a vertically oriented third chamber;

a second conduit connecting the second chamber to the third chamber;

an injection rod disposed vertically within the third chamber; and a injection nozzle located at an upper portion of the third chamber.

2. The vertical injection machine of claim 1, wherein the first conduit comprises a horizontal portion connected to the first chamber and a vertical portion connected to the second chamber, wherein the shutter rod is disposed in the vertical portion.

3. The vertical injection machine of claim 1, wherein the valve head is conical.

4. The vertical injection machine of claim 1, further comprising heaters adjacent to the first chamber to melt sold metal.

5. The vertical injection machine of claim 1, wherein the shutter rod is adapted to allow liquid metal to flow from the first chamber to the second chamber when the shutter rod is lowered to an open position.

6. The vertical injection machine of claim 1, wherein the valve head seals the first conduit when the shutter rod is lifted to a closed position.

7. The vertical injection machine of claim 1, further comprising a lifting mechanism wherein the lifting mechanism is adapted to lift the vertical injection machine towards a fixed mold.

8. The vertical injection machine of claim 1, wherein the injection rod seals the second conduit when raised and the metering rod creates suction when withdrawn.

9. A cold chamber method of injection molding comprising:

(A) melting metal into a liquid state in a first chamber;

(B) passing a portion of the liquid metal to a first conduit;

(C) allowing the portion of melted metal to flow from the first conduit into a second chamber located below the first chamber by opening a shutter disposed in the first conduit;

(D) withdrawing a metering rod in the second chamber;

(E) stopping a flow of metal from the first conduit into the second chamber by closing the shutter in the first conduit;

(F) retracting an injection rod in a third chamber to expose a first opening from the second chamber into the third chamber;

(G) advancing the metering rod to force the portion of metal from the second chamber to the third chamber via the first opening;

(H) advancing the injection rod to close the first opening;

(I) elevating the third chamber towards a stationary mold; and (J) advancing the injection rod to inject the portion of liquid metal from the third chamber through a nozzle into the mold.

10. The method of claim 9, further comprising venting air in the third chamber by advancing the injection rod.

11. The method of claim 9, further comprising elevating the first and the second chamber together with the third chamber.

12. The method of claim 9, wherein the injection rod is advanced at least 15 times as fast in step (J) as in step (H).

13. The method of claim 9, wherein withdrawing the metering rod is step (D) pulls the portion of liquid metal into the second chamber by suction.

14. The method of claim 9, wherein a distanced advanced by the metering rod in step (G) determines the volume of metal forced into the third chamber.

15. The method of claim 9, wherein the third chamber remains elevated until the metal in the mold solidifies.

16. The method of claim 15, further comprising retracting the injection rod and lowering the third chamber away from the mold after the metal solidifies.

17. The method of claim 16, wherein excess metal in mold falls back into the third chamber as the injection rod retracts.

18. The method of claim 17, wherein excess metal in mold is sucked back into the third chamber by suction created by the retraction of the injection rod.

19. The method of claim 18, further comprising separating the die, removing the solidified metal, and lubricating the mold.

20. The method of claim 19, wherein steps (A) through (E) are performed at the same time as the steps of separating the die, removing the solidified metal, and lubricating the mold.

21. The method of claim 9, wherein steps (A) through (E) are performed while the first opening is closed by the injection rod.

22. The method of claim 9, wherein opening the shutter comprises lowering a shutter rod in the first conduit to open a seal between a shutter rod valve head and the first conduit, and closing the shutter comprises raising the shutter rod in the first conduit to form a seal between the shutter rod valve head and the first conduit.

23. A cold chamber vertical injection machine comprising:

a first chamber containing a heating means for melting metal into a liquid state in a first chamber;

a second chamber located below the first chamber;

a passing means for passing a portion of the liquid metal from the first chamber into the second chamber;

a sealing means for sealing the passing means;

a vertically oriented third chamber;

a metering means for drawing in liquid metal from the first chamber into the second chamber and for forcing the portion of metal from the second chamber to the third chamber;

an injection means for sealing an opening between the third chamber and the second chamber and for injecting liquid metal from the third chamber into a mold; and a lifting means for lifting the vertical injection machine toward the mold prior to injecting the liquid metal into the mold and for lowing the vertical injection molding machine away from the mold after injecting the liquid metal into the mold.

* * * * *